US006593377B1

(12) United States Patent
Harford et al.

(10) Patent No.: US 6,593,377 B1
(45) Date of Patent: Jul. 15, 2003

(54) METHOD AND APPARATUS FOR PRODUCING HIGH MOLECULAR WEIGHT LIQUID HYDROCARBONS FROM METHANE AND/OR NATURAL GAS

(75) Inventors: Steven Thomas Harford, Superior, CO (US); Alessandro Giorgio Borsa, Evergreen, CO (US); Nicholas Ernest Vanderborgh, Boulder, CO (US)

(73) Assignee: Blue Star Sustainable Technologies Corporation, Arvada, CO (US)

( * ) Notice: Subject to any disclaimer, the term of this patent is extended or adjusted under 35 U.S.C. 154(b) by 0 days.

(21) Appl. No.: 10/083,176

(22) Filed: Feb. 26, 2002

(51) Int. Cl.[7] ..... C07C 27/00

(52) U.S. Cl. ..... 518/706; 518/702; 518/703; 518/715

(58) Field of Search ..... 518/706, 702, 518/703, 715

(56) References Cited

U.S. PATENT DOCUMENTS

| | | | | |
|---|---|---|---|---|
| 4,568,663 A | | 2/1986 | Mauldin | |
| 5,620,670 A | | 4/1997 | Benham et al. | |
| 5,856,585 A | * | 1/1999 | Sanfilippo et al. | 568/470 |
| 5,883,138 A | | 3/1999 | Hershkowitz et al. | |
| 6,169,120 B1 | * | 1/2001 | Beer | 518/715 |
| 2002/0028853 A1 | * | 4/2002 | Manzer et al. | 518/713 |

OTHER PUBLICATIONS

Linda A. Bruce et al, Ruthenium promotion of FischerTropsch synthesis over coprecipitated cobalt/ceria catalyst, Applied Catalysis A: General, 100 (1993) 51–67.*

* cited by examiner

*Primary Examiner*—J. Parsa
(74) *Attorney, Agent, or Firm*—Holland & Hart LLP; Francis A. Sirr, Esq.

(57) ABSTRACT

A mixture of natural gas and air is converted to a $C_5$–$C_{19}$ diesel fuel-grade liquid hydrocarbon. The natural gas and air mixture is supplied to the input of a catalytic partial oxidation reactor. The carbon-containing gas output of the catalytic partial oxidation reactor is connected as an input to a first Fischer-Tropsch reactor, to thereby form a first diesel fuel grade $C_5$–$C_{19}$ liquid hydrocarbon output. A carbon-containing gas output of the first Fischer-Tropsch reactor is connected to the input of a second Fischer-Tropsch reactor, to thereby form a second diesel fuel grade $C_5$–$C_{19}$ liquid hydrocarbon output. The catalytic partial oxidation reactor contains a platinum group catalyst, a promoted platinum group catalyst, a rhodium catalyst, or a platinum promoted rhodium catalyst. Each of the Fischer-Tropsch reactors contain a catalyst that is made up of from about 3 to about 60 parts-by-weight cobalt and from about 0.1 to about 100 parts-by-weight of at least one metal selected from a group consisting of cerium, lanthanum and ruthenium per 100 parts-by-weight of a support selected from a group consisting of silica, alumina and combinations of silica and alumina, and more preferably a catalyst that is made up of about 20 percent by weight cobalt, about 0.1 percent by weight ruthenium, about 0.1 percent by weight platinum, the remainder being an alumina support.

4 Claims, 1 Drawing Sheet

METHOD AND APPARATUS FOR PRODUCING HIGH MOLECULAR WEIGHT LIQUID HYDROCARBONS FROM METHANE AND/OR NATURAL GAS

BACKGROUND OF THE INVENTION

1. Field of the Invention

This invention relates to the field of chemistry, and more specifically to the conversion of a methane-containing gas-phase input stream to a $C_5$–$C_{19}$ carbon containing liquid-phase output stream that is usable as a compression ignition fuel (i.e., as diesel fuel) without the need for further processing.

2. Description of the Related Art

This invention utilizes at least one Catalytic Partial Oxidation (CPOX) reactor.

Known technologies for converting natural gas, which is mostly methane, into a synthesis gas (syngas) that is a mixture of hydrogen and carbon monoxide, include the CPOX reaction. The CPOX reaction is a mildly exothermic process. CPOX of methane produces a syngas stream having a hydrogen-to-carbon monoxide ratio of about 2, this being close to the optimum that is required by a Fischer-Tropsch reaction.

U.S. Pat. No. 5,883,138, incorporated herein by reference, describes a reactor apparatus for the partial oxidation of light hydrocarbon gases, such as methane, to convert such gases to synthesis gas for recovery and/or subsequent hydrocarbon synthesis.

The present invention also utilizes at least one Fischer-Tropsch reactor.

The Fischer-Tropsch reaction is a well-known mechanism for hydrogenating carbon monoxide or synthesis gas into a mixture of olefins, paraffins, and oxygenates in the presence of transition metal based catalysts. Such catalysts may incorporate a first row non-noble metal such as iron, cobalt, or nickel as the predominant active site, along with a noble metal (ruthenium, platinum, rhenium), actinide (thorium), or alkali (lithium, sodium, potassium) promoter, optionally supported on a refractory, non-reducible, oxide such as silica, alumina, or titania.

Conversion of synthesis gas by way of the Fischer-Tropsch reaction occurs as a result of the following highly-exothermic chemical process.

$$CO+2H_2 \rightarrow CH_2+H_2O$$

A cobalt-based Fischer-Tropsch catalyst is a catalyst of choice for the conversion of synthesis gas to-liquid fuels due to the high activity and the long life of this type of catalyst. A tubular-fixed bed Fischer-Tropsch reactor or a slurry-phase Fischer-Tropsch reactor can be used, with temperature control being less of a problem when a slurry-phase Fischer-Tropsch reactor is used.

Wax and hydrocarbon condensate that is produced by the slurry-phase Fischer-Tropsch process are predominantly linear paraffin wax having a small fraction of olefin and oxygenate. Hydrogenation of the olefins and oxygenates, and hydro-cracking of the wax to naphtha and diesel can be done under relatively mild conditions.

It is known that gas-phase hydrocarbons can be converted into liquid-phase hydrocarbons via a two step process such as is shown in U.S. Pat. No. 5,620,670 to Benham et al., of which U.S. Pat. No. 5,324,335 is a division, both incorporated herein by reference.

U.S. Pat. No. 5,620,670 teaches converting a hydrocarbon-containing gas into liquid hydrocarbon products that have a carbon content between $C_5$ and $C_{20}$. In this patent, a first reaction converts a hydrocarbon-containing or methane-rich feed into hydrogen and carbon monoxide in the presence of carbon dioxide. The hydrogen and carbon monoxide are then reacted in a Fischer-Tropsch reactor using a promoted iron oxide or iron-based unsupported catalyst, to thereby form liquid hydrocarbon products, including diesel fuels. Partial oxidation (POX) and steam reforming can be used to convert the hydrogen-containing gases into a mixture of hydrogen and carbon monoxide. That is, POX and steam reforming can be used to produce synthesis gas from methane. In both of these processes, high temperatures and low pressures are said to favor production of the synthesis gas, with POX being favored because it is self-sustaining; i.e., it does not require the addition of heat once the reactants have been preheated. This patent states that two catalyst types that attract the most attention for the Fischer-Tropsch reactor are cobalt-based catalysts and iron-based catalysts, where cobalt-based catalysts approach 100% carbon conversion efficiency, whereas iron-based catalysts tend toward 50% carbon conversion efficiency during the Fischer-Tropsch synthesis reaction. It is suggested that iron-based catalyst used in the Fischer-Tropsch reactor be a precipitated iron catalyst, and most preferably, an unsupported precipitated iron catalyst that is promoted with predetermined amounts of potassium and copper using elemental iron and copper as starting materials.

Also of interest is U.S. Pat. No. 6,169,120 to Beer, incorporated herein by reference. This patent describes a two-stage, slurry bubble column, Fischer-Tropsch synthesis process that is particularly adapted for use with synthesis gas containing nitrogen. Two Fischer-Tropsch reactors each contain a catalyst comprising cobalt, ruthenium, or cobalt and ruthenium on a support comprising at least one inorganic metal oxide selected from Group IIIA, IIIB, IVB, VB, VIB and VIIB metal oxides, alumina, silica, silica alumina, and combinations thereof, at a temperature from about 380 to about 500 degrees F., at a pressure from about 15 to about 25 atmospheres, and at a carbon monoxide conversion from about 40 to about 60 percent, to produce a liquid hydrocarbon product. A separator that is located downstream from the second reactor provides a $C_5$ –$C_{17}$ hydrocarbon output stream.

U.S. Pat. No. 4,568,663 to Mauldin, incorporated herein by reference, states that natural gas, or methane, can be converted into synthesis gas, that conversion of the synthesis gas to hydrocarbons can be carried out via Fischer-Tropsch synthesis, and that the use of Fischer-Tropsch synthesis for the production of hydrocarbons from carbon monoxide and hydrogen are well known. It is also stated that promoted and supported Group VIII non-noble metals iron, cobalt and nickel have been used in Fischer-Tropsch reactions. This patent provides a supported cobalt catalyst, notably cobalt titania (cobalt titanium dioxide) and cobalt thoria titania (cobalt thorium dioxide titanium dioxide) for use in methanol conversion reactions in Fischer-Tropsch synthesis. A particulate catalyst is described consisting of a catalytically active amount of cobalt, or cobalt and thoria, to which rhenium is added.

SUMMARY OF THE INVENTION

The present invention provides a method and an apparatus for the production of high molecular weight fuel-grade liquid hydrocarbons from gas phase low molecular weight hydrocarbons. That is, fuel-grade liquid hydrocarbons are produced, the fuel-grade liquid hydrocarbons having a larger number of carbon atoms per molecule than do the gas-phase hydrocarbons.

In accordance with the invention, a mixture of air (about 79 percent by weight nitrogen and about 21 percent by weight oxygen) and gas phase, low molecular weight hydrocarbons (for example, natural gas or methane, $CH_4$) is processed by a series reactor arrangement having an initial CPOX reactor followed by one or more Fischer-Tropsch reactors, wherein each of the one or more Fischer-Tropsch reactors provides a high molecular weight, fuel-grade, liquid-phase hydrocarbon output, for example, a liquid hydrocarbon output having a carbon content of from about $C_5$ to about $C_{19}$.

This fuel-grade liquid hydrocarbon output finds utility as a fuel for compression ignition internal combustion engines; i.e., diesel engines, without the need for hydro-processing.

The invention is comprised of at least three-step reaction process steps.

The first reaction step utilizes a CPOX reactor wherein a gas-phase hydrocarbon input is passed in contact with a first catalyst to produce a first gaseous mixture of carbon monoxide and hydrogen.

The first catalyst is a platinum group catalyst, a promoted platinum group catalyst, a rhodium catalyst, or a platinum promoted rhodium catalyst.

The second reaction step utilizes a synthesis zone (i.e. a first Fischer-Tropsch reactor) wherein the above-mentioned first gaseous mixture of carbon monoxide and hydrogen is passed in contact with a second catalyst, and is thus converted into a mixture of high molecular weight liquid-phase hydrocarbons and low molecular weight gas-phase hydrocarbons.

The second catalyst is made up of from about 3 to about 60 parts by weight cobalt and from about 0.1 to about 100 parts by weight of at least one metal selected from a group consisting of cerium, lanthanum, platinum, and ruthenium per 100 parts by weight of a support selected from a group consisting of silica, alumina, and a combinations of silica and alumina. A preferred second catalyst is made up of about 20 percent by weight cobalt, about 0.1 percent by weight ruthenium, about 1.0 percent by weight platinum, the remainder being alumina support.

The liquid-phase output of this second reaction step comprises a soft wax and naphtha fractions simultaneously with a middle distillate carbon constituent that boils in the traditional diesel temperature range, this being the formulation of the output of the second reaction step (i.e., the output of the first Fischer-Tropsch reactor).

This liquid-phase output of the first Fischer-Tropsch reactor finds direct utility, without further processing, as a middle distillate, compression ignition, fuel exhibiting about 30 percent naphtha by weigh.

The retention of both naphtha and soft wax within the liquid-phase output of the first Fischer-Tropsch reactor (as opposed to the prior art use of hydro-processing) adds value to the diesel fuel by way of the diesel fuel naphtha fraction, and permits direct utilization of the output of the first Fischer-Tropsch reactor as a compression-ignition fuel.

Savings on the order of from about 10 to about 15 percent are realized as a result of the elimination of the need to hydro-process the output of this first Fischer-Tropsch reactor.

Direct production of a lubricity additive, capable of providing polar functionalities such as hydroxyl or carbonyl groups, is an extension of the output of the first Fischer-Tropsch reactor. In particular, higher alcohols of carbon number 12 to 18 can be produced in-situ in a fashion analogous to the production of naphtha, middle distillate and soft wax via the first Fischer-Tropsch reaction of the invention.

As a third step feature of the invention, a low molecular weight gas-phase output of the first Fischer-Tropsch reactor may be applied to a second Fischer-Tropsch reactor, to thereby produce another high molecular weight liquid-phase output from the second Fischer-Tropsch reactor. This liquid-phase output also finds direct utility, without further processing as a middle distillate compression-ignition fuel.

BRIEF DESCRIPTION OF THE DRAWING

The single FIGURE of this application shows a three-reactor embodiment of the invention.

DESCRIPTION OF THE PREFERRED EMBODIMENTS

Figure 1:
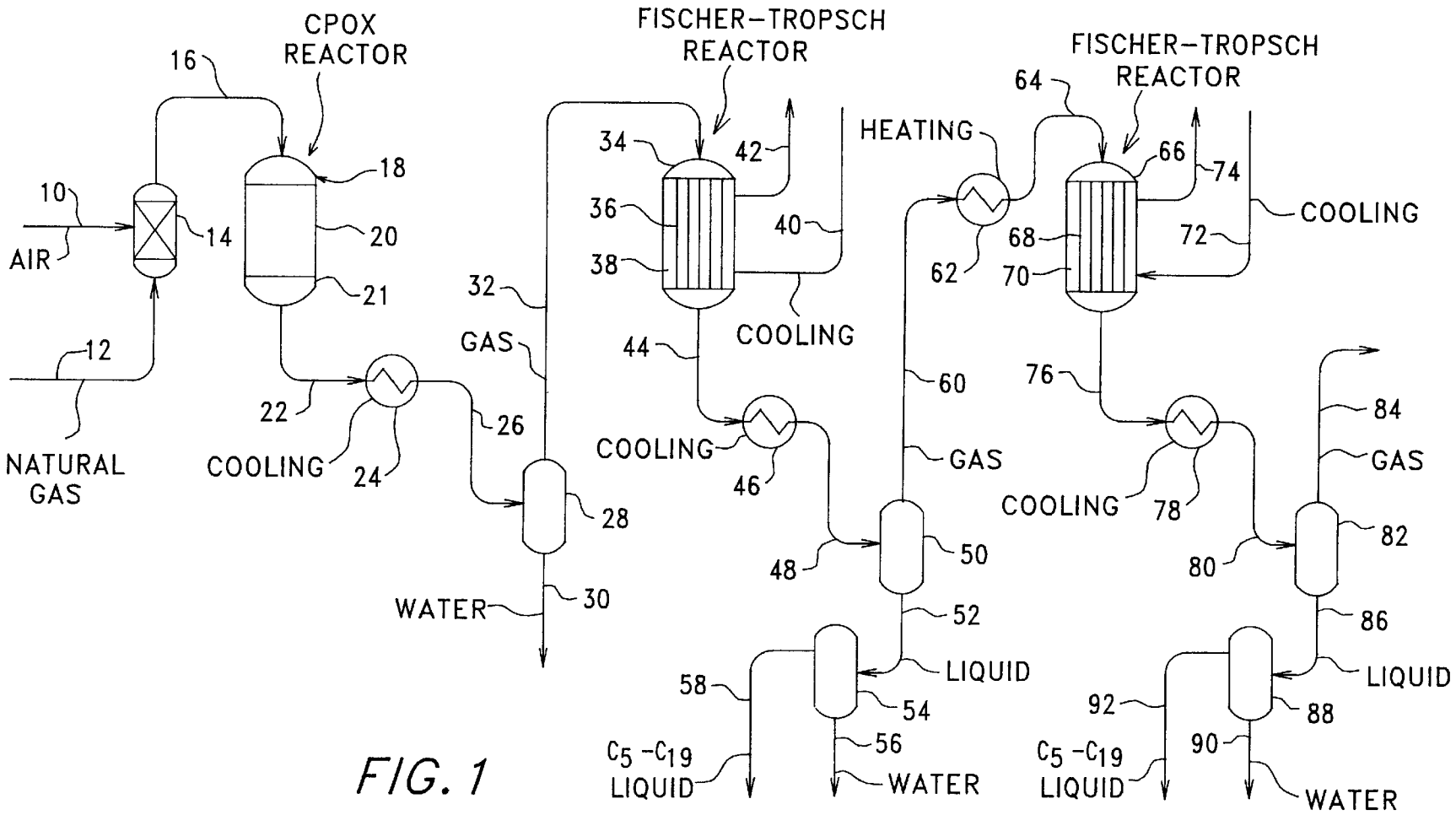

The figure provides a schematic diagram that shows a three-reactor embodiment of the invention. The spirit and scope of the invention is not to be limited to details that are shown in this figure.

Three chemical reactors are provided within the system shown in this figure; namely, a CPOX reactor 18 having a metal vessel, a first Fischer-Tropsch synthesis reactor 34 having a metal vessel, and a second Fischer-Tropsch synthesis reactor 66 having a metal vessel. Without limitation thereto, Fischer-Tropsch synthesis reactors 34 and 66 can be packed bed reactors, and CPOX reactor 18 can be a honeycomb reactor or a packed bed reactor, with packed bed being preferred.

The system of this figure also includes three cooling-type heat exchangers 24, 46 and 78, one heating-type heat exchanger 62, three liquid/gas separators 28, 50 and 82, and two liquid separators 54 and 88.

CPOX reactor 18 includes a metal vessel 21 that contains a particulate-type catalyst bed 20. In accordance with the invention, catalyst bed 20 contains a platinum group catalyst, more preferably a promoted platinum group catalyst, still more preferably a rhodium catalyst, and most preferably a rhodium catalyst having a platinum promoter.

Compressed natural gas (for example, a combustible mixture of methane and higher hydrocarbons) or methane at a pressure of about 20 bar and at a flow rate of about 50 standard cubic feet per minute is supplied to a metal gas-mixing vessel 14 by way of line 12.

Compressed ambient air, oxygen, or an oxygen-containing gas, at a pressure of about 20 bar and at a flow rate of about 180 standard cubic feet per minute is supplied to mixing vessel 14 by way of line 10.

The natural gas and air output mixture of vessel 14 is then provided as an input to CPOX reactor 18 by way of line 16 at a pressure of about 20 bar, and at a flow rate of about 230 standard cubic feet per minute.

CPOX reactor 18 operates to convert from about 80 to about 95 percent of the natural gas within feed 16 to a synthesis gas, which synthesis gas exits CPOX reactor 18 by way of line 22.

Without limitation thereto, synthesis gas 22 is composed of carbon dioxide, carbon monoxide, hydrogen, water, nitrogen, and unreacted natural gas or methane.

Also without limitation thereto, the composition of synthesis gas 22 includes from about 40 to about 50 percent by volume nitrogen, from about 2 to about 5 percent by volume carbon dioxide, and the hydrogen to carbon monoxide ratio of synthesis gas 22 is from about 1.9 to about 2.3.

In an embodiment of the invention, CPOX reactor 18 operated at a temperature of from about 700 to about 1000 degrees centigrade, and at a pressure of from about 2 to about 25 bar and preferably about 20 bar.

The high-temperature synthesis gas output stream 22 of CPOX 21 is supplied to a cooling-type metal heat exchanger 24 that operates such that the synthesis gas output 26 of heat exchanger 24 is at a temperature of from about 25 to about 40 degrees centigrade.

The cooled synthesis gas 26 is then passed to the input of a metal separator vessel 28 in order to remove liquid water from synthesis gas stream 26. The dry synthesis gas output 32 of separator 28 is then provided as an input to synthesis reactor 34, i.e. to the input of a first Fischer-Tropsch reactor 34, as liquid water exits separator 28 by way of line 30 and is discarded.

First Fischer-Tropsch reactor 34 includes a plurality of generally linear, parallel and vertically-extending metal tubes 36, each tube 36 being packed with a particulate-type catalyst.

In an embodiment of the invention, the catalyst within tubes 36 comprised from about 3 to about 60 parts-by-weight cobalt, from about 0.1 to about 100 parts-by-weight of at least on metal selected from a group consisting of cerium, lanthanum, platinum, and ruthenium, all per 100 parts-by-weight of a support selected from a group consisting of silica, alumina, and combinations of silica and alumina. Preferably, the catalyst within tubes 36 comprised about 20 percent by weight cobalt, about 0.1 percent by weight ruthenium, about 1.0 percent by weight platinum, the remainder being an alumina support.

Fischer-Tropsch reactor 34 operated at an input flow rate through line 32 of about 200 standard cubic feet per minute, at a temperature of from about 125 to about 350 degrees centigrade, and more preferably at a temperature of from about 175 to about 275 degrees centigrade, at a pressure of from about 5 to about 100 bar, and most preferably, at a pressure of about 20 bar. It is to be noted that a 3-to-6 molar expansion occurs within CPOX reactor 18 (i.e., $2CH_4+O_2=2CO+4H_2$).

Synthesis gas 32 passes through tubes 36 and is thereby converted into liquid hydrocarbons composed primarily of $C_5$–$C_{19}$. During this conversion process heat is released. This heat is removed from Fischer-Tropsch reactor 34 by a cooling liquid (for example, oil, water, or another suitable liquid) that passes into the shell side 38 of Fischer-Tropsch reactor 34 by way of a relatively cool input line 40, and passes out of Fischer-Tropsch reactor 34 by way of a relatively warmer output line 42. As is well known, the flow 40, 42 of cooling liquid is controlled to provide a stable operating temperature for Fischer-Tropsch reactor 34.

Un-reacted synthesis gas and product hydrocarbons exit Fischer-Tropsch reactor 34 by way of line 44, where they pass to a cooling metal heat exchanger 46 whereat their temperature drops to a temperature of from about 25 to about 40 degrees centigrade.

The output 48 of heat exchanger 46 then passes to a metal separator vessel 50. In separator 50 a liquid component within the output 48 of heat exchanger 46 is removed and sent to another metal separator 54 by way of line 52.

Separator 54 operates to separate water from its input 52. The water output 56 of separator 54 is discarded, whereas the output 58 of separator 54 is liquid hydrocarbon having a $C_5$–$C_{19}$ content. This $C_5$–$C_{19}$ output 58 is usable as diesel fuel without the need for further processing.

Output line 60 extending from separator 50 carries un-reacted synthesis gas to a heating-type heat exchanger 62 whereat the un-reacted synthesis gas is preheated to a temperature of from about 150 to about 200 degrees centigrade. The heated output 64 of heat exchanger 62 is then provided as an input to Fischer-Tropsch reactor 66.

Fischer-Tropsch reactor 66 includes a plurality of generally linear, parallel and vertically-extending metal tubes 68, each tube 68 being packed with a particulate-type catalyst.

In an embodiment of the invention, the catalyst within tubes 68 comprises from about 3 to about 60 parts-by-weight cobalt and from about 0.1 to about 100 parts-by-weight of at least one metal selected from a group consisting of cerium, lanthanum, platinum, and ruthenium, all per 100 parts-by-weight of a support selected from a group consisting of silica, alumina, and a combination of silica and alumina. Preferably, the catalyst within tubes 69 comprised about 20 percent by weight cobalt, about 0.1 percent by weight ruthenium, about 1.0 percent by weight platinum, the remainder being alumina support.

In addition, Fischer-Tropsch reactor 66 operated at an input flow rate of about 140 standard cubic feet per minute (i.e. at about 60 percent of the input flow rate of Fischer-Tropsch reactor 34), at a temperature of from about 125 to about 350 degrees centigrade, and more preferably at a temperature of from about 175 to about 275 degrees centigrade, and at a pressure of from about 5 to about 100 bar, and more preferably at a pressure of about 20 bar.

Synthesis gas 64 passes through tubes 68 and is thereby converted into liquid hydrocarbons composed primarily of $C_5$–$C_{19}$. During this conversion, process heat is released. This heat is removed from Fischer-Tropsch reactor 66 by a cooling liquid (for example, oil, water, or another suitable liquid) that passes into the shell side 70 of Fischer-Tropsch reactor 66 by way of a relatively cool input line 72 and a relatively warmer output line 74. Again, well-known cooling means are provided to maintain Fischer-Tropsch reactor 66 at a stable operating temperature.

Un-reacted synthesis gas and product hydrocarbons exit Fischer-Tropsch reactor 66 by way of line 76, where they pass to a cooling-type heat exchanger 78 whereat their temperature drops to a temperature of from about 25 to about 40 degrees centigrade.

The output 80 of heat exchanger 78 then passes to a metal separator vessel 82. In separator 82, a liquid component within the output 80 of heat exchanger 78 is removed and sent to another metal separator 88 by way of line 86.

Separator 88 operates to separate water from its input 86. The water output 90 of separator 88 is discarded, whereas the output 92 of separator 88 is a $C_5$–$C_{19}$ liquid hydrocarbon that is usable as diesel fuel without the need for further processing.

Output line 84 extending from separator 82 carries un-reacted synthesis gas. Within the spirit and scope of the invention, un-reacted synthesis gas 84 can be passed to a third Fischer-Tropsch reactor, un-reacted synthesis gas 84 can be utilized as a source of energy, or un-reacted synthesis gas 84 can be discarded as by burning.

While the invention has been above-described in detail while making reference to various embodiments thereof, this detailed description is not to be taken as a limitation on the spirit and scope of the invention.

What is claimed is:

1. A method of converting a mixture of a low molecular weight hydrocarbon gas and air into a $C_5$+ liquid hydrocarbon having direct utility as a compression-ignition fuel in the absence of further processing, comprising the steps of:

providing a packed-bed catalytic partial oxidation reactor;

providing a first catalyst in said catalytic partial oxidation reactor selected from a group consisting of a platinum-group catalyst, a promoted platinum-group catalyst, a rhodium catalyst, and a platinum-promoted rhodium catalyst;

providing a mixture of low molecular weight hydrocarbon gas and air to an input of said catalytic partial oxidation reactor;

providing a first packed-bed Fischer-Tropsch reactor;

providing a second supported catalyst in said first Fischer-Tropsch reactor consisting of from about 3 to about 60 parts-by-weight cobalt and from about 0.1 to about 100 parts-by-weight of at least one metal selected from a group consisting of cerium, lanthanum, platinum and ruthenium per 100 parts-by-weight of a support selected from a group consisting of silica, alumina and combinations of silica and alumina;

providing an output of said catalytic partial oxidation reactor to an input of said first Fischer-Tropsch reactor; and separating an output of said first Fischer-Tropsch reactor into a first liquid-phase compression-ignition fuel output and a first gas-phase output in the absence of recycling of any portion of said output of said first Fischer-Tropsch reactor to said catalytic partial oxidation reactor.

2. The method of claim 1 including the step of:

cooling said output of said catalytic partial oxidation reactor prior to applying said output of said catalytic partial oxidation reactor to said input of said first Fischer-Tropsch reactor.

3. The method of claim 1, including the steps of:

providing a second packed-bed Fischer-Tropsch reactor;

providing said second catalyst in said second Fischer-Tropsch reactor;

providing said first gas-phase output to an input of said second Fischer-Tropsch reactor; and separating an output of said second Fischer-Tropsch reactor into a second liquid-phase compression-ignition fuel output and a second gas-phase output in the absence of recycling of any portion of said output of said second Fischer-Tropsch reactor to said first Fischer-Tropsch reactor.

4. The method of claim 3 including the steps of:

cooling said output of said catalytic partial oxidation reactor prior to providing said output of said catalytic partial oxidation reactor to said input of said first Fischer-Tropsch reactor; cooling said output of said first Fischer-Tropsch reactor prior to separating said output of said first Fischer-Tropsch reactor into said first liquid-phase compression-ignition fuel output and said first gas-phase output;

heating said first gas-phase output prior to providing said first gas-phase output to said input of said second Fischer-Tropsch reactor; and cooling said output of said second Fischer-Tropsch reactor prior to separating said output of said second Fischer-Tropsch reactor into said second liquid-phase compression-ignition fuel output and said second gas-phase output.

* * * * *